US006567341B2

(12) United States Patent
Dreyer et al.

(10) Patent No.: US 6,567,341 B2
(45) Date of Patent: May 20, 2003

(54) BOOM SYSTEM AND ITS USE TO ATTENUATE UNDERWATER SOUND OR SHOCK WAVE TRANSMISSION

(75) Inventors: Harold B. Dreyer, Anchorage, AK (US); William F. Gunderson, III, Astoria, OR (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 09/989,219

(22) Filed: Nov. 20, 2001

(65) Prior Publication Data

US 2002/0080681 A1 Jun. 27, 2002

Related U.S. Application Data

(60) Provisional application No. 60/252,323, filed on Nov. 20, 2000.

(51) Int. Cl.[7] ..... H04K 3/00
(52) U.S. Cl. ..... 367/1; 181/296; 405/115
(58) Field of Search ..... 367/24, 1; 181/296; 405/52, 115; 210/150

(56) References Cited

U.S. PATENT DOCUMENTS

| | | | | |
|---|---|---|---|---|
| 3,659,713 A | | 5/1972 | Mueller | |
| 3,713,540 A | | 1/1973 | Davidson et al. | |
| 3,979,289 A | | 9/1976 | Bykowski et al. | |
| 4,178,245 A | | 12/1979 | Nakaoka et al. | |
| 4,219,423 A | | 8/1980 | Smith, Jr. | |
| 4,288,321 A | | 9/1981 | Beane | |
| 4,296,884 A | | 10/1981 | Luebke | |
| 4,419,232 A | | 12/1983 | Arntyr et al. | |
| 4,582,048 A | | 4/1986 | Sorensen | |
| 4,625,302 A | * | 11/1986 | Clark | 181/110 |
| 4,669,972 A | | 6/1987 | Koblanski | |
| 4,692,059 A | | 9/1987 | Juutilainen | |
| 4,749,479 A | | 6/1988 | Gray | |
| 4,880,333 A | | 11/1989 | Glasser et al. | |
| 4,919,820 A | | 4/1990 | Lafay et al. | |
| 5,102,261 A | | 4/1992 | Gunderson, III | |
| 5,197,821 A | | 3/1993 | Cain et al. | |
| 5,220,958 A | | 6/1993 | Bernhardt | |
| 5,225,622 A | | 7/1993 | Gettle et al. | |
| 5,322,629 A | | 6/1994 | Stewart | |
| 5,345,741 A | | 9/1994 | Slater et al. | |
| 5,354,456 A | | 10/1994 | Montgomery et al. | |
| 5,354,459 A | | 10/1994 | Smith | |
| 5,372,711 A | | 12/1994 | Sill | |
| 5,394,786 A | | 3/1995 | Gettle et al. | |
| 5,427,679 A | | 6/1995 | Daniels | |
| 5,558,462 A | | 9/1996 | O'Haver | |
| RE36,297 E | | 9/1999 | Heino et al. | |
| 5,959,938 A | * | 9/1999 | Behrens | 181/120 |
| 5,992,104 A | | 11/1999 | Hudak | |
| 6,346,193 B1 | * | 2/2002 | Bauer | 210/150 |

FOREIGN PATENT DOCUMENTS

| | | |
|---|---|---|
| FR | 2195-238 | 8/1972 |
| FR | 2284-709 | 9/1974 |
| FR | 2329-808 | 11/1975 |
| FR | 2579-239 A | 3/1985 |
| GB | 2 246 981 A | 2/1992 |
| WO | WO 91/07546 | 5/1991 |
| WO | WO 99/19570 | 4/1999 |

* cited by examiner

*Primary Examiner*—Ian J. Lobo
(74) *Attorney, Agent, or Firm*—Nixon Peabody LLP

(57) ABSTRACT

The present invention relates to methods of attenuating underwater transmission of sound or shock waves as well as boom systems designed for such use. The boom system is characterized by a material (e.g., curtain or combination curtain and skirt) which extends substantially the entire water column when placed in a body of water, thereby defining a perimeter and a gas injection system which includes a plurality of outlets which are positioned between the perimeter and the site of underwater activity. In use, the boom system is installed such that it surrounds the site of underwater activity and then gas is injected into the water through the plurality of outlets to form a gas curtain during performance of an underwater activity capable of generating sound or shock waves.

19 Claims, 3 Drawing Sheets

BOOM SYSTEM AND ITS USE TO ATTENUATE UNDERWATER SOUND OR SHOCK WAVE TRANSMISSION

This application claims the priority benefit of U.S. Provisional Patent Application Serial No. 60/252,323 filed Nov. 20, 2000, which is hereby incorporated by reference in its entirety.

FIELD OF THE INVENTION

The present invention relates generally to containment booms and, more particularly, to containment booms which are adapted for use in connection with sites of underwater activity which can produce sound or shock waves.

BACKGROUND OF THE INVENTION

Underwater explosives as well as construction and demolition work, in general, produce sound or shock waves that travel in all directions from the site of activity at a rate of approximately four times the speed it would travel in air. Water is also non-compressible, whereas air is compressible. Thus, water more effectively transmits the energy of the sound or shock wave to the surrounding environments. As a result, underwater explosions or construction or demolition work quite often lead to severe injury or death of large numbers of marine life as a result of the crushing effect the sound or shock waves have on internal air cavities of the marine life. Generally speaking, regulatory agencies require some means for minimizing the impact of underwater detonations.

One approach which has been utilized previously involves the provision of an air curtain, which is simply the result of releasing compressed air below the water surface such that the rising air bubbles form a semi-continuous perimeter about the site of work. The presence of the air bubbles about the perimeter have the effect of dispersing the sound or shock waves produced by the worksite, thereby absorbing the intensity of the sound or shock wave and allowing the transmission of, hopefully, only non-lethal sound or shock waves whose intensity is greatly dissipated as compared to the initial sound or shock waves emanating from the site of work. One problem with this approach is that the air curtain is often dispersed by tidal currents, thereby decreasing its efficacy. Depending on how great the air curtain becomes dispersed, it may have little or no effect.

Therefore, it would be desirable to provide a containment boom which overcomes this deficiency in the art.

SUMMARY OF THE INVENTION

A first aspect of the present invention relates to a method of attenuating underwater transmission of sound or shock waves which includes: surrounding a site of underwater activity with a boom system including (i) a support system, (ii) a curtain including a sheet of flexible material which allows water to flow therethrough, the curtain being suspended from the support system such that the curtain extends substantially the entire water column to define a perimeter enclosure, and (iii) a gas injection system including a plurality of outlets which surround the site of underwater activity, the plurality of outlets being positioned between the site of underwater activity and the curtain; and injecting gas into the water through the plurality of outlets to form a gas curtain during performance of an underwater activity capable of generating sound or shock waves, whereby the curtain minimizes dissipation of the gas curtain to improve the efficacy of sound or shock wave attenuation as compared to a gas curtain in the absence of the curtain.

A second aspect of the present invention relates to a method of attenuating underwater transmission of sound or shock waves which includes: surrounding a site of underwater activity with a boom system including (i) a support system, (ii) a curtain including a sheet of flexible material which allows water to flow therethrough, the curtain being suspended from the support system such that an upper end thereof is positioned above the water level and a lower end thereof positioned above the floor of the body of water, (iii) a skirt including a sleeve formed of a material which resists folding and a ballast positioned within the sleeve, the skirt being connected to the lower end of the curtain or to the support system, wherein the curtain and the skirt together extend substantially the entire water column, with the ballast-weighted skirt resting against the floor of the body of water, thereby defining a perimeter, and (iv) a gas injection system including a plurality of outlets which surround the site of underwater activity, the plurality of outlets being positioned between the site of underwater activity and the perimeter; and injecting gas into the water through the plurality of outlets to form a gas curtain during performance of an underwater activity capable of generating sound or shock waves, whereby the curtain minimizes dissipation of the gas curtain to improve the efficacy of sound or shock wave attenuation as compared to a gas curtain in the absence of the curtain and skirt.

A third aspect of the present invention relates to a boom system which includes: a support system; a curtain including a sheet of flexible material which allows water to flow therethrough, the curtain being suspended from the support system such that, upon introduction into a body of water, an upper end thereof is positioned above the water level and a lower end thereof is positioned above the floor of the body of water; and a skirt including a sleeve formed of a deformable material which resists folding and a ballast positioned within the sleeve, the skirt being connected to the lower end of the curtain or to the support system, wherein upon introduction into a body of water the curtain and the skirt together extend substantially the entire water column, with the ballast-weighted skirt resting against the floor of the body of water.

DETAILED DESCRIPTION OF THE INVENTION

Figure 1:
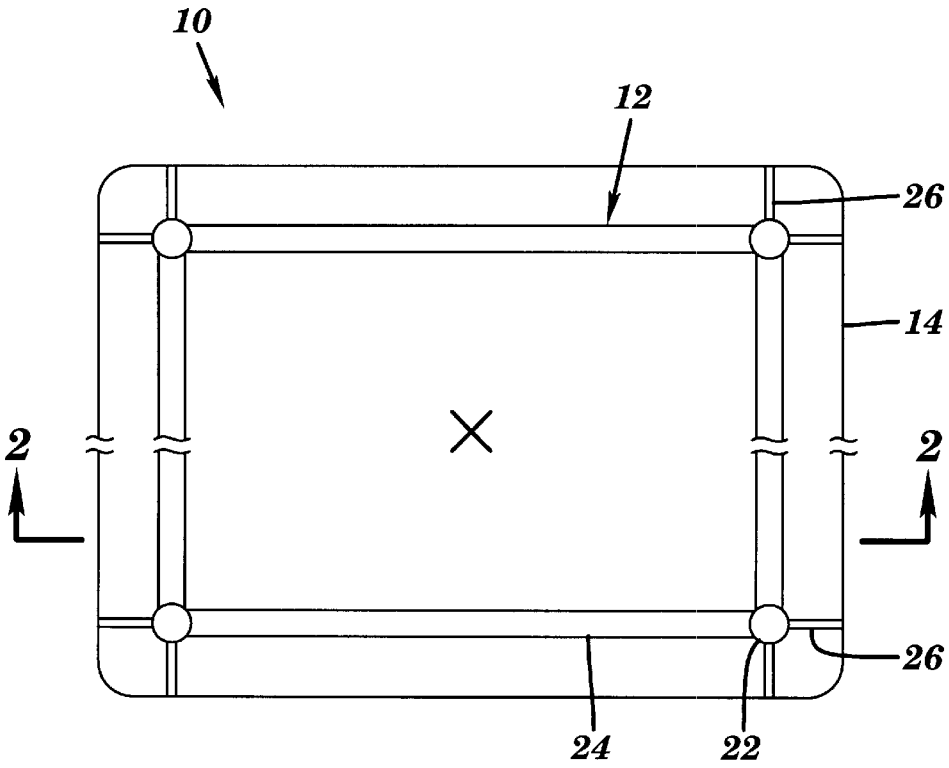
FIG. 1 is a top plan view illustrating a boom system according to one embodiment of the present invention.

The present invention relates to methods of attenuating underwater transmission of sound or shock waves as well as boom systems designed for such use. Regardless of the boom system structure, as described hereinafter, the boom system is characterized by a material (e.g., curtain or combination curtain and skirt) which extends substantially the entire water column when placed in a body of water, thereby defining a perimeter and a gas injection system which includes a plurality of outlets which are positioned between the perimeter and the site of underwater activity (e.g., detonation sites, construction sites, or demolition sites, etc.). In operation, the plurality of outlets release a flow of gas, which collectively forms a "gas curtain" of rising gas bubbles. Because the gas curtain is formed between the perimeter and the site of activity, the material which defines the perimeter prevents the water currents from dissipating the gas curtain. As a result, greater attenuation of the sound or shock waves can be achieved as compared to a gas curtain alone.

The methods of the present invention are carried out by surrounding the site of activity with such a boom system and then injecting gas into the water through the plurality of outlets to form a gas curtain during performance of an underwater activity capable of generating sound or shock waves, whereby the curtain minimizes dissipation of the gas curtain to improve the efficacy of sound or shock wave attenuation as compared to a gas curtain in the absence of the boom system.

The boom systems include a support system, a curtain and (optionally) a skirt, and a gas injection system.

The support system can be a floating support system or a permanent or semi-permanent support system.

Floating support systems can include a plurality of conventional flotation units usable with the present invention, such as inflatable devices, air bags, and floats made from buoyant materials, such as cork, synthetic foams, and other plastics. However, conventional devices may not perform adequately under adverse conditions. It has been found that under adverse conditions, expanded polystyrene ("EPS") is especially suitable for use as the flotation unit. It is desirable to coat or seal the EPS to prevent deterioration associated with prolonged exposure to the elements. EPS is commercially available from ARCO Chemical Company as DYLITE® and can be formed or molded into flotation units of various sizes and shapes (e.g., cylindrical, square, etc.) as required by project design. The EPS has a positive buoyancy that keeps the flotation unit substantially above the water surface at all times, allowing the flotation unit to ride the waves, even in adverse conditions. An EPS flotation unit is not deformed by wave action and does not lose buoyancy if punctured, as would an inflatable device. A single cubic foot of EPS can support as much as 60 lbs. A commonly used size of flotation unit of EPS is an 8" to 12" diameter cylindrical configuration, but the size can be readily adapted to meet specific wave and environmental conditions and depth requirements.

Depending upon the circumstances of the installation, a permanent or semi-permanent support system can be used rather than the floating support system afforded by use of the EPS or other buoyant materials. Such support systems can include pilings of conventional construction and horizontal support members (i.e., a wire, beam, catwalk, or other like support) which extend between adjacent pilings. The boom curtain can be connected to either the horizontal support members or both the horizontal support members and the pilings. These alternative support systems are described in U.S. Pat. No. 6,485,229, to Gunderson et al., filed Oct. 8, 1998, which is hereby incorporated by reference in its entirety.

For most applications, it is sufficient to construct the curtain with a single layer of geosynthetic fabric. However, for some applications, a multilayer construction may be desirable to provide added strength or protection against abrasion. The layers could be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. Pat. No. 6,485,229 to Gunderson et al., filed Oct. 8, 1998, which is hereby incorporated by reference in its entirety.

The flexible fabric used in the curtain is preferably a geosynthetic fabric, which can be either woven or nonwoven. The geosynthetic fabric is "hydrophobic" or "water-pervious," meaning that water passes through the fabric. The hydrophobic property of geosynthetic fabric permits the passage of water current through the main body portion of the curtain, thereby maintaining the relative shape and position of the boom even in adverse current conditions, and also facilitating towing.

Typically, the geosynthetic fabric will be "oleophilic," meaning that it absorbs or attracts oil, thereby blocking the flow of oil. For containment of silt and other suspended particulates, it is not essential that the curtain be oleophilic; obviously, for containment of oil, the curtain preferably is oleophilic. Useful geosynthetic fabrics are further characterized by high load distribution capacity, the ability to abate material filtration, and permeability to water. Geosynthetic fabrics are commercially available in a range of tensile strengths, permeabilities, and permitivities, and are useful for the purposes of the invention throughout those ranges.

The geosynthetic fabrics are nonbiodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090, 2000, 2006 (all polypropylene fabrics commercially available from Amoco Fabrics and Fibers Company).

Other relevant parameters for the boom curtain include, but are not limited to, water depth, particulate size, length of time the boom is to be in place, pollutant composition, and the availability of manpower and equipment.

The gas injection typically includes one or more compressors of adequate capacity to introduced a compressed gas, e.g., air, into the water via a system of conduits and underwater diffusers which contain a plurality of outlets permitting escape of the compressed gas.

Figure 2:
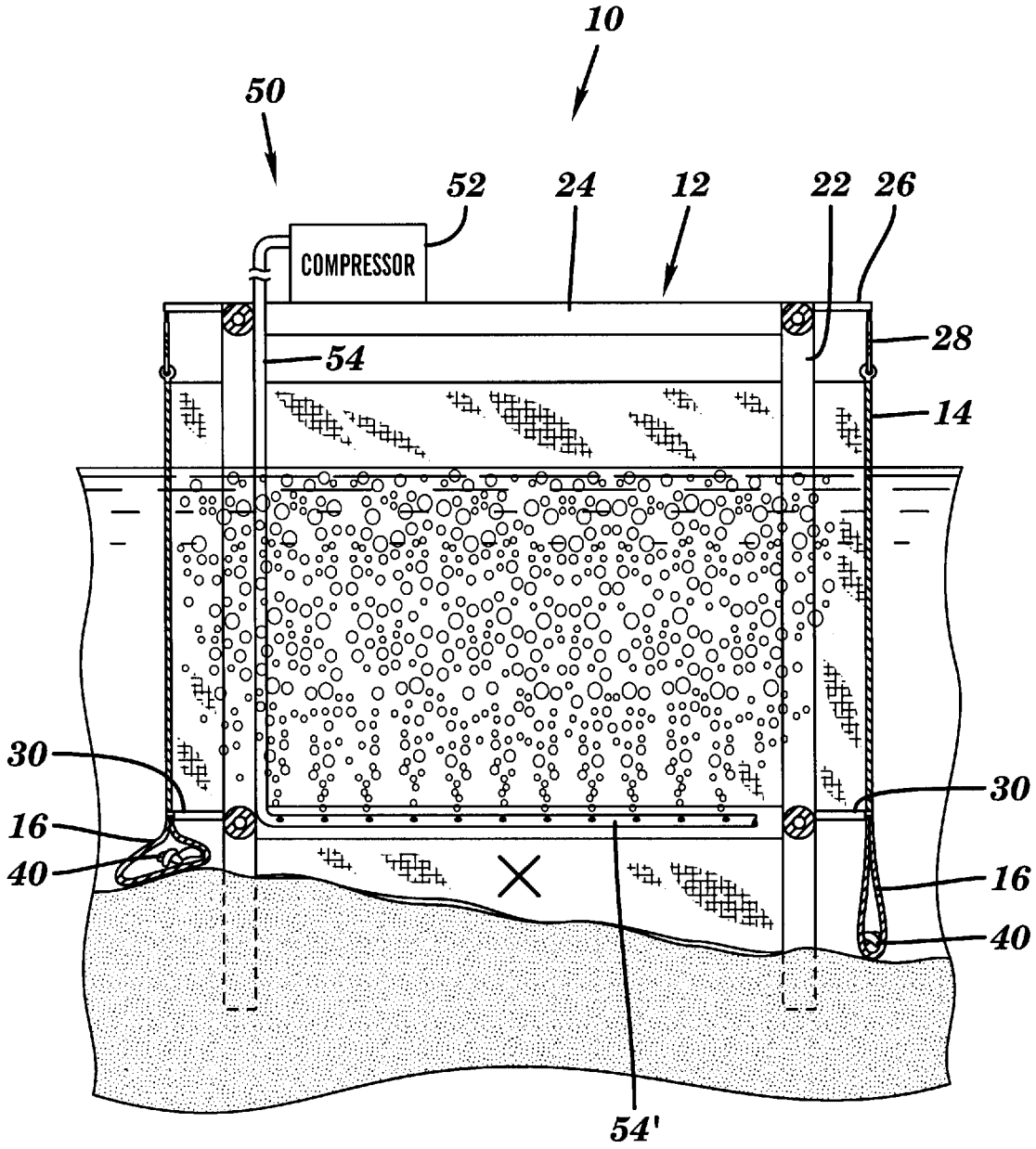
FIG. 2 is a cross-sectional view of the boom system along lines 2—2 in FIG. 1.

Referring now to FIGS. 1 and 2, a boom system 10 is shown surrounding a site of underwater activity, denoted by the large X. The boom system includes a support system 12, a curtain 14 suspended from the support system such that the curtain extends substantially the entire water column, a skirt 16 connected to the support system (and along with the curtain defining a perimeter enclosure), and a gas injection system 50.

The support system 12 is a rigid, permanent or semi-permanent support system formed of suitable materials, such as steel, PVC pipe, or other known components sufficient for its intended use. As shown, the support system 12 includes vertical supports 22, horizontal supports 24, and outriggers 26. When placed into a body of water, the vertical supports 22 may penetrate the floor of the body of water to some extent. Because of the non-uniformity of most floors, the vertical supports will likely penetrate to different degrees. If the contour of the floor is known (i.e., mapped) prior to installation of the support system, then the support system can be constructed accordingly such that the support system is relatively level and stable.

The curtain 14 is shown suspended from the support system by adjustable turnbuckles 28, which allow the height of the curtain to be adjusted once the boom is installed about a site. Depending on the length and height of the curtain 14, the curtain can be assembled from a number of components are connected together using, e.g., zipper connections of the type disclosed in U.S. Provisional Patent Application No. 60/328,757 to Dreyer, filed Oct. 11, 2001, which is hereby incorporated by reference in its entirety.

Figure 3:
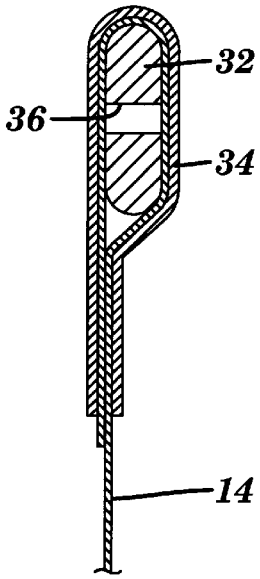
FIG. 3 is a cross-sectional view illustrating a reinforcement bar inserted at the upper or lower edge of a curtain for use in the boom system of FIG. 1.

As shown in FIG. 2, the lower end of the curtain is connected to a structural element 30. To prevent the curtain from damage during use, as shown in FIG. 3 the edges thereof can be reinforced by a reinforcement bar 32 and additional layers 34 of either the same material used to form the curtain 14 or another heavy duty flexible fabric material. The reinforcement bar can be constructed of any suitable material which will endure the strain applied, such as steel. Although only the upper edge of the curtain is shown in FIG. 3, the same type of reinforcement can also be provided at the lower edge thereof, particularly if the lower edge is intended to be connected to the support structure. With the reinforcement at the upper and/or lower edges, the curtain 14 can be connected to the support structure using conventional connectors, such as bolts which pass through apertures 36 through the reinforcement bars.

Also connected to the structural element 30 is a skirt 16. The skirt is formed of a deformable material which resists folding. An example of this material is the type of heavy gauge sheeting which is used to form conveyor belts. Another example of this material is a rubberized canvas (or similar fabric). Such materials are pliable enough to allow the material to take on a conformation of a sleeve, with the edges of the material joined together where the skirt 16 attaches to the structural element 30. Within the sleeve is a ballast 40, which maintains the skirt against the floor of a body of water upon introduction of the boom into the water. The skirt enables a sufficiently tight seal to form against the floor of the body of water. As shown in FIG. 2, the skirt accommodates different distances between the floor and the structural element 30 (i.e., the upper end of the skirt). When the distance is near a maximum, the ballast 40 causes the skirt to elongate to form a sufficiently tight seal against the floor. Yet when the distance is near a minimum, the skirt bellows outwardly without folding. The ballast 40 again helps to maintain a sufficiently tight seal with the floor when the skirt 16 is compressed.

The boom system also includes a gas injection system, generally denoted 50. The system includes a compressor 52 in fluid communication with a series of conduits 54, 54'. As shown in FIG. 2, the conduit 54' is spaced inwardly of the perimeter defined by the curtain 14 and skirt 16. Conduit 54' includes a plurality of outlets which surround the site of underwater activity. During use, the compressed gas (e.g., air) is introduced into the conduits 54, 54' and compressed gas is released from the plurality of outlets, thereby forming a "gas curtain" located in between the site of activity and the curtain 14. As noted above, this relationship between the curtain and "gas curtain" minimizes dissipation of the gas curtain to improve the efficacy of sound or shock wave attenuation as compared to a gas curtain in the absence of the boom system.

Figure 4:
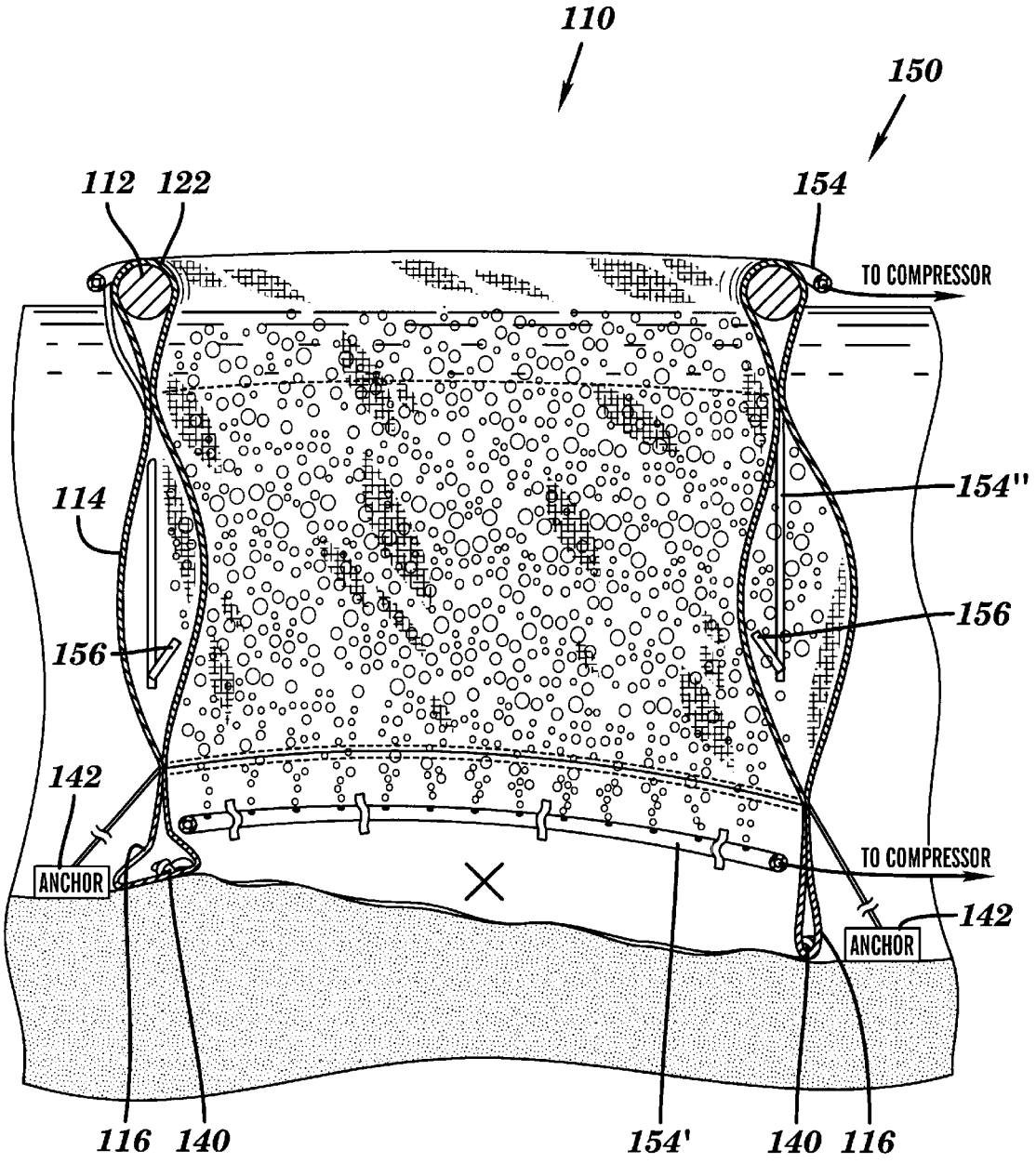
FIG. 4 is a cross-sectional view illustrating a boom system according to an alternative embodiment of the present invention.

Referring now to FIG. 4, a boom system 110 is shown surrounding a site of underwater activity, denoted by the large X. The boom system includes a support system 112, a curtain 114 suspended from the support system such that the curtain extends substantially the entire water column, a skirt 116 connected to the support system (and along with the curtain defining a perimeter enclosure), and a gas injection system 118 (only shown in part).

The curtain 114 includes two sheets of material, which can be the same or different. The curtain is also provided with an upper sleeve 122, which is formed by folding the material over and connecting an edge of the sheet to itself (by sewing, heat fusion, etc.). The manufacture of such curtains is known in the art and taught in U.S. Pat. No. 6,485,229 to Gunderson et al., filed Oct. 8, 1998, which is hereby incorporated by reference in its entirety.

The support system in this embodiment is a flotation unit, more specifically, a plurality of flotation units. The flotation units are received within the upper sleeve 122 of the curtain 114. The upper sleeve can be provided with a number of openings or slots which facilitate the insertion of the flotation units into the sleeve during assembly.

The skirt 116 is substantially the same as skirt 16 shown in FIG. 2, although the skirt is connected directly or indirectly to the bottom edge of curtain 114. This connection can be a mechanical connection, i.e., using sewing or zipper connections, or the skirt can be heat sealed to the curtain. The skirt 116 is also equipped with a ballast 140. The skirt 116 functions in a manner analogous to skirt 16 as described above.

To maintain the skirt 116 in position, i.e., prevent water currents from shifting the position of the skirt, the lower edge of the curtain 114 can be tethered to anchors 142 using cables or the like. Although anchors are illustrated as being located external of the curtain perimeter, it should be appreciated that anchors can also be installed internal of the curtain perimeter.

As shown in FIG. 4, the boom system also includes a gas injection system. The system includes a compressor (not shown) in fluid communication with a series of conduits 154, 154'. As shown in FIG. 4, the conduit 154' is attached to the inner side of the skirt 116. Conduit 154' includes a plurality of outlets which surround the site of underwater activity. During use, the compressed gas (e.g., air) is introduced into the conduits 154, 154' and compressed gas is released from the plurality of outlets, thereby forming a "gas curtain" located in between the site of activity and the curtain 114. As noted above, this relationship between the curtain and "gas curtain" minimizes dissipation of the gas curtain to improve the efficacy of sound or shock wave attenuation as compared to a gas curtain in the absence of the boom system.

Conduit 154' is shown attached to skirt 116, however, it should be appreciated by those of skill in the art that conduit 154' can be anchored adjacent the floor independently of the curtain or skirt.

As noted above, the curtain 114 include two sheets of material. The two sheets can be joined together forming a series of cells or panels of various dimension, but usually vertically aligned. Each of the cells or panels can be equipped with a conduit 154" coupled to a diffuser 156 that includes a plurality of outlets (located between the two sheets). As compressed gas is delivered through the diffuser, a second "gas curtain" is essentially formed in between the two sheets of material. This can further enhance the effectiveness in attenuating the sound or shock wave transmission.

The various features of the present invention can be utilized in any variety of combinations. For example, the support systems and curtain configurations shown in FIGS. 2 and 4 are not limited to use together. Thus, a single layer curtain as shown in FIG. 2 can be used in connection with a support system which is formed of flotation units. Likewise, the two layered curtain as shown in FIG. 4 can be used in connection with a permanent or semi-permanent support system as shown by the frame in FIGS. 1–2.

Moreover, depending upon the size of the detonation and the strength of the resulting sound or energy waves, one or more boom systems of the present invention may be necessary.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A method of attenuating underwater transmission of sound or shock waves comprising:

surrounding a site of underwater activity with a boom system comprising:

a support system, a curtain comprising a sheet of flexible material which allows water to flow theretbrough, the curtain being suspended from the support system such that an upper end thereof is positioned above the water level and a lower end thereof positioned above the floor of the body of water, a skirt comprising a sleeve formed of a deformable material which resists folding but is not a geosynthetic material and a ballast positioned within the sleeve, the skirt being connected to the lower end of the curtain or to the support system, wherein the curtain and the skirt together extend substantially the entire water column, with the ballast-weighted skirt resting against the floor of the body of water, thereby defining a perimeter, and a gas injection system comprising a plurality of outlets which surround the site of underwater activity, the plurality of outlets being positioned between the site of underwater activity and the perimeter;

injecting gas into the water through the plurality of outlets to form a gas curtain during performance of an underwater activity capable of generating sound or shock waves, whereby the curtain minimizes dissipation of the gas curtain to improve the efficacy of sound or shock wave attenuation as compared to a gas curtain in the absence of the curtain and skirt.

2. The method according to claim 1, wherein the curtain comprises only one sheet of flexible material.

3. The method according to claim 1, wherein the curtain comprises two sheets of flexible material and the gas injection system further comprises a second plurality of outlets which surround the site of underwater activity, the second plurality of outlets being positioned between the two sheets of flexible material which form the curtain.

4. The method according to claim 3 further comprising:

injecting gas into the water through the second plurality of outlets during performance of the underwater activity to form a second gas curtain.

5. The method according to claim 1, wherein the support system is a flotation member.

6. The method according to claim 1, wherein the support system is a permanent or semi-permanent structure.

7. The method according to claim 1, wherein the deformable material which resists folding is a rubberized canvas.

8. The method according to claim 1, wherein the deformable material which resists folding is a heavy gauge sheeting.

9. A boom system comprising:

a support system;

a curtain comprising a sheet of flexible material which allows water to flow therethrough, the curtain being suspended from the support system such that, upon introduction into a body of water, an upper end thereof is positioned above the water level and a lower end thereof is positioned above the floor of the body of water; and a skirt comprising a sleeve formed of a deformable material which resists folding but is not a geosynthetic material and a ballast positioned within the sleeve, the skirt being connected to the lower end of the curtain or to the support system, wherein upon introduction into a body of water the curtain and the skirt together extend substantially the entire water column, with the ballast-weighted skirt resting against the floor of the body of water.

10. The boom system according to claim 9, wherein the curtain comprises only one sheet of flexible material.

11. The boom system according to claim 9 further comprising:

a gas injection system comprising a plurality of outlets located on one side of the curtain.

12. The boom system according to claim 11, wherein the curtain comprises two sheets of flexible material and the gas injection system further comprises a second plurality of outlets positioned between the two sheets of flexible material which form the curtain.

13. The boom system according to claim 9, wherein the support system is a flotation member.

14. The boom system according to claim 9, wherein the support system is a permanent or semi-permanent structure.

15. The boom system according to claim 9 further comprising:

means for suspending the curtain from the support structure.

16. The boom system according to claim 15, wherein the means for suspending is adjustable.

17. The boom system according to claim 16, wherein the means for suspending comprise a plurality of turnbuckles.

18. The boom system according to claim 7, wherein the deformable material which resists folding is a rubberized canvas.

19. The boom system according to claim 7, wherein the deformable material which resists folding is a heavy gauge sheeting.

* * * * *